United States Patent [19]

Kan et al.

[11] Patent Number: 4,784,928

[45] Date of Patent: Nov. 15, 1988

[54] REUSABLE ELECTROPHOTOGRAPHIC ELEMENT

[75] Inventors: Hsin-Chia Kan, Fairport; Bruce R. Benwood, Churchville; William J. Staudenmayer, Pittsford, all of N.Y.

[73] Assignee: Eastman Kodak Company, Rochester, N.Y.

[21] Appl. No.: 902,851

[22] Filed: Sep. 2, 1986

[51] Int. Cl.[4] ..... G03G 5/14

[52] U.S. Cl. ..... 430/58; 430/126

[58] Field of Search ..... 430/66, 58, 124, 126; 428/32 T, 461

[56] References Cited

U.S. PATENT DOCUMENTS 3,652,271 3/1972 Bornarth et al. ..... 430/89

3,938,992 2/1976 Jadwin et al. ..... 430/124

4,012,255 3/1977 McMullen .

4,030,921 6/1977 Akira et al. .

4,663,259 5/1987 Fujimura et al. ..... 430/67

*Primary Examiner*—John L. Goodrow

*Attorney, Agent, or Firm*—Bernard D. Wiese

[57] ABSTRACT

Image transfer properties of an electrophotographic imaging element are improved by heterogeneously dispersing, as a separate phase within the photoconductive surface layer of the element, finely divided particles of an abhesive substance which is nonconductive and spreadable and to which toner particles adhere less strongly than to the composition of the surface layer in the abhesive substance. An example of the abhesive substance is a particulate low molecular weight telomer of tetrafluoroethylene.

6 Claims, 1 Drawing Sheet

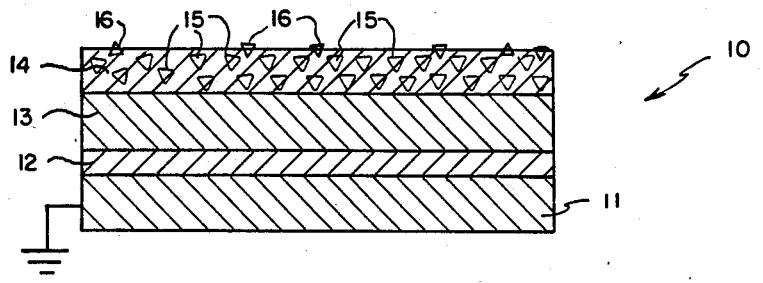
16
15
16
15
14
13
12
11
10

REUSABLE ELECTROPHOTOGRAPHIC ELEMENT

FIELD OF THE INVENTION

This invention relates to electrophotography and more particularly to a reusable electrophotographic imaging element having improved image transfer properties.

BACKGROUND OF THE INVENTION

In electrophotographic imaging processes, such as in electrophotographic coping machines employing reusable photoconductors, an electrostatic latent-image charge pattern is formed of a photoconductive element which can be in the form of a belt, drum or plate. By treating the charge pattern with a dry developer containing charged toner particles, the latent image is developed. The toner pattern is then transferred to a receiver such as a sheet of paper to which it is fixed by fusion or other means.

A problem in transferring the developed image in this kind of process is that the attraction of the toner to the electrophotographic element can cause incomplete transfer to the receiver element. The resulting transferred image on the receiver has hollow characters and other defects. The problem is especially severe when the image is transferred by pressing a receiver element such as a paper sheet into contact with the toned surface of the photoconductive element..

Efforts to solve the image-transfer problem have included providing abhesive or release coatings to photoconductive elements. A drawback of this attempt to solve the problem is that an insulating, nonphotoconductive overcoat can interfere with the photoconductive properties of the element. If the coating is thick, it can materially reduce the electrophotographic speed or sensitivity. Even if thin, an insulating overcoat layer can shorten the life of a photoconductor such that it cannot be regenerated for repeated use. This is believed to be caused by the trapping of residual charges between the insulating coating and the photoconductive layer. If the surface is merely coated with a soft release substance such as a metal stearate, the coating rapidly wears off and the transfer problem reappears.

Although evidently not providing improvded image transfer, a tetrafluoroethylene telomer identified by the trademark "Vydax 1000" of E. I. duPont deNemours and Company is disclosed as a component of an overcoating composition for an electrostatographic photoreceptor in the patent to McMullen, U.S. Pat. No. 4,012,255. It is incorporated with a crosslinkable polymer coated over a selenium arsenic photoconductor. An insulating overcoating such as this would have the disadvantages previously mentioned of reducing the electrophotographic sensitivity and of interfering with the regenerative capability of the element. Furthermore, the crosslinked polymer, being abrasion-resistant, would not continually yield a fresh film of telomer as the surface is rubbed at a cleaning station or otherwise. Hence, the improved image transfer obtained in accordance with the present invention would not be expected.

In accordance with the present invention, a novel reusable electrophotographic element is provided from which, even after many cycles of use, toner can readily be uniformly transferred to a contiguous receiver element by pressure rollers or other means with minimal image defects.

SUMMARY OF THE INVENTION

The reusable electrophotographic imaging element of the invention has a photoconductive surface layer adapted to receive an electrostatic charge latent image and to receive charged dry toner particles which form the toner image for transfer to a receiver element. The surface layer comprises an uncrosslinked binder resin, a photoconductor and, heterogeneously dispersed within the layer as a separate phase, finely divided particles of an abhesive substance which is nonconductive and spreadable and to which toner adheres less strongly than to photoconductive surface layer in the absence of the abhesive substance.

In a preferred embodiment, the electrophotographic element is a multilayer photoconductive element and the abhesive substance is a low molecular weight, wax-like, normally solid telomer of tetrafluoroethylene.

THE DRAWINGS

The sole FIGURE of the drawing is an enlarged diagrammatic sectional view of a photoconductive element of the invention showing the separate phase distribution of abhesive particles within the surface layer of the element.

DETAILED DESCRIPTION

To describe the invention in more detail, reference will be made to the drawings which illustrates diagrammatically one type of electrophotographic imaging element of the invention, namely, a multilayer photoconductive element. This kind of element, also called a multiactive photoconductive element, has separate charge generation and charge transport layers. The configuration and principles of operation of multiactive photoconductive elements are known, having been described in a number of patents, for example, in the patent to Berwick et al, U.S. Pat. No. 4,175,960.

In the drawing, the photoconductive element 10 has a conductive support 11, a charge-generation layer 12, a first charge-transport layer 13 and a second charge-transport layer 14 which is the surface layer of the element. The conductive support 11 can be of conventional structure comprising, for example, a nickel coated poly(ethylene terephthalate) film. The charge-generation and charge-transport layers can comprise organic or inorganic photoconductors dispersed in a non-crosslinked, binder resin such as a polycarbonate or polyester. Most significantly, with respect to the present invention, the photoconductive surface layer 14 has dispersed within it, as a separate phase, irregularly shaped particles 15 and 16 of an electrically nonconductive, spreadable abhesive substance.

The abhesive substances used in the electrophotographic elements of the invention can be selected from a broad class of such substances. They are electrically nonconductive and are soft enough to be spreadable. By this is meant that under conditions of use, for example, in an electrophotographic copying machine at room temperature, they can be spread in a thin film over substantially the entire surface layer of the photoconductive element by the rotating fiber brush of the cleaning station. By abhesive is meant that the substance adheres less strongly to the toner than does the composition of the surface layer of the photocondcutive element in the absence of the abhesive substance. Desirably also, the abhesive substance adheres less strongly to the toner than does the paper or other receiver surface. Preferably, the abhesive substance is a waxy solid, which is spreadable at room temperature. An especially preferred example is the product of E. I. duPont de Nemours and Company known as "Vydax AR" telomer, which is a low-molecular-weight (approximately 3700 m.w.) telomer of tetrafluoroethylene. Other useful abhesive substances for incorporation within the surface layer as a separate phase, as distinguished from being merely coated over the surface layer, include spreadable solids such as calcium, zinc and magnesium stearates and polyolefin waxes and various fluorocarbon polymers such as the polytetrafluoroethylene powder sold by Micro Powders, Inc. of Yonkers, N.Y. under the name "Fluo HT." This is a polymer of fine particle size, i.e., average particle=2 μm and maximum=9 μm, which melts at about 320° C. Other useful polytetrafluoroethylenes include products of ICI sold under the designations L-170, L-171, L-169 and WC-8 and the product of Allied Chemical Company sold as "Polymist F5A" polymer.

Although solid particulate substances are desirable, suitable abhesive substances also include normally liquid, nonconductive abhesive substances such as poly(dimethylsiloxane) liquids. These too can be heterogeneously dispersed within the surface layer as a separate phase of finely divided particles which are spreadable on the surface of the imaging element. These various abhesive substances can be dispersed as a separate phase within the surface layer of the element of the invention as the sole abhesive substance or in admixture with others.

When used for electrophotographic imaging, the surface layer 14 of element 10 is charged in the dark to a suitable voltage, e.g., a negative voltage of 600 volts. The charged element is exposed imagewise to a pattern of actinic radiation such as visible light, causing charges in the exposed areas of the surface layer to dissipate. The surface is then contacted with finely divided particles of a charged dry toner such as pigmented thermoplastic resin particles to develop the electrostatic-charge latent image.

Because this is a reusable imaging element, the toner image is then transferred to a paper sheet or other receiver sheet where it is fixed by heat, pressure or other means. The transfer can conveniently be accomplished by pressing the receiver sheet into contact with the toned surface of the photoconductive element, e.g., by passage through the nip of pressure rollers, which are suitably electrically biased to attract the charged toner particles from the photoconductive layer to the paper.

As already indicated, toner-transfer techniques in the past have been more or less inefficient. Surface forces holding the toner to the photoconductive layer have caused incomplete transfer of the toner and image defects have resulted, of which the "hollow character" defect has been especially serious. According to theory, the hollow-character defect is caused by the cohesion of toner particles to each other and their adhesion to the photoconductor when compressed by a pressure roller during the image-transfer operation. The toner particles appear to compact into aggregates of which only the edges transfer readily, thus forming hollow characters on the receiving substrate. The defect is particularly evident at the edges of dense solid areas, and in the centers of fine lines and alphanumeric characters, which contain little toner. If severe enough, the image becomes unreadable.

Although, the scope of the invention is not to be bound by theoretical explanations of its mechanisms, a possible explanation can be given for the difference in results obtained in accordance with the invention as compared with attempts to improve image transfer by means of abhesive or release coatings on photoconductors. These wear off as the photoconductor is reused and soon lose their effectiveness. If thick enough to be effective for repeated use, they interfere with the electrical properties of the photoconductor.

In contrast, in the photoconductive elements of the present invention, a spreadable abhesive substance is dispersed as a separate phase of particles within the photoconductive layer. As shown in the drawing, some of these particles 16 are at the surface of the photoconductive element. When the surface is rubbed, for instance, by the rotating brush in the cleaning station of a copying machine, the abhesive particles at the surface are spread as a thin coating over the photoconductive element. This coating is so thin, e.g., no more than about 0.1 μm and preferably no more than about 0.02 μm, that it does not interfere substantially with the electrical properties of the element, yet it aids in image transfer by providing a release or abhesive surface for the element. Furthermore, the effect is lasting because the repeated rubbing action of the cleaning station continually spreads a fresh coating of the abhesive substance. In effect, the top layer of the photoconductive element serves as a reservoir for the spreadable abhesive substance. This mechanism helps to explain why the relatively immobile separate particles dispersed in the photoconductor provide a long lasting effect on image transfer while a homogeneous solution of a fluorinated polymer as disclosed in U.S. Pat. No. 4,030,921 would not.

In support of this theory of the mechanism is the observation that optimum image transfer occurs with a new unused photoconductive element of the invention only if its surface is first rubbed or polished to spread a thin film of the protruding particles of the abhesive substance over the surface. When the element is used in a copying machine, the cleaning station of the machine serves this function and will continually provide a fresh thin abhesive coating for a long period of use.

The photoconductive elements of the invention comprise an electrically conductive support and at least one photoconductive layer. The photoconductive surface layer, which is charged, exposed and developed, contains the separate phase of particles of an insulating spreadable abhesive substance. Since the surface layer containing the abhesive particles is a photoconductive layer which has no more than a thin coating of non-photoconducting insulating material, the electrophotographic sensitivity of the electrophotographic element of the invention is not adversely affected by the abhesive particles. The element therefore has optimum sensitivity while having low surface activity which facilitates the efficient transfer of toner images.

In the simplest of the various layer configurations in accordance with the invention, a single photoconductive layer is disposed on a conductive support. Also included within the scope of the invention are multilayer, or so-called multiactive, photoconductive elements in which a thin charge generation layer is formed on the conductive substrate and one or more thicker charge transport layers are disposed over the charge generation layer. Examples of multiactive elements are disclosed in the patented Wright et al, U.S. Pat. No. 4,111,693; Berwick et al, U.S. Pat. No. 4,175,960; and Borsenberger et al, U.S. Pat. No. 4,578,334.

Still another configuration is the inverted multilayer element in which a charge transport layer is coated on the conductive substrate and a charge generation layer is the surface layer. Examples of inverted multilayer elements are disclosed in the patent to Berwick et al, U.S. Pat. No. 4,175,960.

In whichever of these configurations is selected, the abhesive substance is in the photoconductive surface layer. Furthermore, if the element is a multilayer element having a charge transport layer as the surface layer, then a second charge transport layer which is free of the separate phase abhesive substance preferably should be placed between the charge generation layer and the surface layer containing the abhesive substance. The reason this preferred is that, when the separate phase abhesive substance is in a charge transport surface layer contiguous to the charge generation layer, the element does not discharge as completely at full exposures as does an element having an intermediate charge transport layer containing no particulate abhesive substance. In the art, this is referred to as a "hanging toe" problem, although it is not a problem for all types of imaging systems.

It should be understood that, in addition to the principal layers which have been discussed, i.e., the conductive substrate and the charge generation and charge transport layers, the photoconductive elements of the invention can also contain other layers of known utility, such as subbing layers to improve adhesion of contiguous layers and barrier layers to control unwanted charge transport. The surface layer can even have a thin release coating such as a thin coating of silicone oil or of fluorocarbon polymer or the like if it is desired to augment the release qualities provided by the particulate abhesive substance dispersed within the surface layer. Any such coating however, should be sufficiently thin that, as an insulating, non-photoconductive substance, it does not substantially reduce the electrophotographic sensitivity of the element.

The following example describes the preparation of a photoconductive element having a particulate fluorocarbon telomer abhesive substance dispersed in the surface layer in accordance with the invention.

PREPARATION EXAMPLE

A composition for the charge-transport surface layer of a multiactive photoconductive element is prepared from (a) 240 g of a binder resin, which is a polyester of 4,4'-(2-norbornylidenediphenol with a 60/40 molar ratio of a terephthalic acid and azelaic acid, (b) 150 g of a mixture of three photoconductors, (c) 0.96 g of DC-510 silicone surfactant of Dow Corning Company (identified as methylphenylsiloxane polymer), and (d) 3600 g of the solvent, dichloromethane. The charge-transport materials are organic photoconductors of the types disclosed in U.S. Pat. Nos. 3,542,544 and 4,127,412. The photoconductors are magnetically stirred in the solvent for 10 min. The binder and surfactant are mixed and then stirred in a closed brown bottle overnight to achieve solution. Then the abhesive substance particles are added in sufficient amount to give a weight ratio of binder: photoconductors: abhesive substance of 40:40:20. In this example, the abhesive substance is "Vydax AR" fluorotelomer. This product of E. I. duPont de Nemours and Company is obtained as a dispersion of 20 weight % of the white, waxy, short chain telomer of tetrafluoroethylene (molecular weight approximately 3700) in "Freon TF" solvent, the latter being a trademark of E. I. duPont deNemours and Company for trichlorotrifluoroethane. Before blending the telomer with the charge transport layer mixture, its solvent is evaporated and the solid waxy telomer is ball milled in methylene chloride and mixed with the photoconductive layer. The resulting composition is coated as the charge transport surface layer of 4 μm dry thickness over another charge-transport layer which contains the same binder and photoconductors in a 60:40 weight ratio, but contains none of the abhesive substance, and is 8 μm in thickness. The 8 μm layer is coated on an emitter or charge generation layer of 5 μm thickness deposited on a conductive support which is a nickelized polyester film. The emitter layer and other layers under the charge transport layers are of the types described in U.S. Pat. No. 4,175,960. Prior to use, the surface layer of the resulting multilayer photoconductive element is polished or rubbed with cotton for several minutes to ensure uniform spreading of the tetrafluoroethylene telomer on the imaging surface.

The example which follows describes the testing of photoconductive elements of the invention in comparison with controls.

COMPARISON EXAMPLE

As a control, a multilayer element having a single charge transport layer (12 μm thickness) as the surface layer and containing no tetrafluoroethylene telomer was prepared, the other components being the same as in the previous example. Four additional elements were prepared having otherwise the same composition but having different concentrations of tetrafluoroethylene polymer in the surface layer ranging from 10 to 30 weight percent. The five photoconductive elements were then tested for hollow character image defects and toner transfer efficiency in an electrophotographic copying apparatus equipped for magnetic brush development. Table I below summarizes the results of the tests using hand polished new and used photoconductive films and an electrophotographic copying apparatus equipped with a resistive electrostatic roller transfer device. The elements were electrostatically charged, exposed to a test pattern and then developed with a dry toner powder comprising a styrene-acrylic thermoplastic binder resin and a quinacridone pigment. Before testing, the surface of each photoconductive element was hand polished by rubbing for several minutes with a cotton swab. Others, before being tested for image transfer, were given a treatment which simulated the wear or abrasion resulting from 10,000 cycles of imaging and cleaning. In this treatment the PC film was charged, exposed and developed and then all toner was removed at a cleaning station. To avoid waste of paper, the transfer step was eliminated in the wear treatment and this was therefore, a somewhat harsher wear treatment than would occur in normal imaging, transfer and cleaning cycles. The wear tester, after 10,000 cycles, removed approximately 1–2 μm from the top layers of the elements. Table I below summarizes the results of the image transfer tests with the hand polished new photoconductive elements and with the elements subjected to 10,000 cycles on the wear tester.

TABLE I

| Wt. % Fluorocarbon Telomer | Hollow Characters | |
|---|---|---|
| | Hand Polished Samples | After 10K Cycles on Wear Tester |
| none (control) | yes | yes |
| 10 | yes | yes |
| 15 | no | no |
| 20 | no | no |
| 25 | no | no |
| 30 | no | no |

As the table shows, no hollow characters were observed in the elements having 15% or more of the fluorocarbon telomer in the surface layer.

Although hollow characters appeared in the images from the element containing only 10% of the abhesive substance, this is not the minimum useful concentration. Variations in surface layer thicknesses and in the simulated image transfer apparatus can influence the concentration at which the defect appears.

REGENERATION TESTS

Five photoconductive films which differed as to whether they contained abhesive particles in the surface layer and as to the arrangement of the layers were tested for electrical regeneration characteristics. The film compositions and structures were as follows:

I. A multilayer film as in the "Preparation Example" comprising (a) a charge transport surface layer containing no abhesive particles; (b) a charge generation layer; and (c) a conductive support.

II. A film such as I but containing 20 weight percent Vydax AR abhesive particles in the surface charge transport layer.

III. A multilayer film as shown in the drawings, having two charge transport layers with 20 weight percent Vydax AR abhesive particles in the surface layer.

IV. A film having a single photoconductive layer, i.e., an emitter layer, coated on a conductive support and containing no abhesive particles.

V. A single layer film such as IV but containing 20 weight percent Vydax AR abhesive particles in the surface emitter layer.

In the regeneration tests, each film was charged to an initial voltage with a corona charger and exposed to white light through a step wedge having clear, gray and black steps. The residual charges were erased by illumination and the cycle was repeated 2100 times. Film voltage measurements were made at the beginning of each cycle to evaluate the electrical stability of each film as it was tested. The following table lists the film voltages in the areas corresponding to the black and clear areas of the step wedge i.e., V black and V white, initially and after 2100 cycles.

TABLE II

| Film | Initial Voltage | | 2100 Cycles | |
|---|---|---|---|---|
| | Vblack | Vwhite | ΔVblack | ΔVwhite |
| I | 590 | 90 | 0 | −5 |
| II | 680 | 385 | −115 | −240 |
| III | 615 | 150 | −5 | −30 |
| IV | 500 | 60 | −105 | −10 |
| V | 410 | 90 | −155 | −10 |

The initial voltages listed in the table are the film voltages remaining after the initial charge and the white light exposure. As the Vblack column shows, no charge was dissipated in the area where the light exposure was blocked by the black area of the step wedge. The Vwhite column lists the voltages in the film areas where full exposure to white light was made through the clear area of the step wedge. In these areas the charge was dissipated to a residual fog level. The table also lists the changes in these film voltages after 2100 cycles, which indicates the electrical regeneration capability of each film after repeated cycles of use. Films I and IV, which contained no abhesive substance, regenerated satisfactorily but, of course, these films would have the image transfer problems of prior art films. Films III and V represent photoconductive elements of the invention which contained abhesive particles in the surface photoconductive layer. Both of them regenerated satisfactorily and would also have the superior image transfer properties which characterize the elements of the present invention. On the other hand, film II did not regenerate as well as the other films. As previously explained, for optimum regeneration characteristics, the preferred multilayer elements of the invention should contain at least two charge transport layers and the one contiguous with the charge generation layer or layers should not contain the abhesive material.

Although the examples have described specific photoconductive layer compositions, it should be understood that the photoconductive elements of the invention can employ a wide range of photoconductors, binders and other components of photoconductive elements, including the various photoconductive materials described in Research Disclosure, No. 10938, published May 1973, pages 62 and 63; the heterogeneous photoconductors of the patent to Light, U.S. Pat. No. 3,615,414 and the patent to Fox et al, U.S. Pat. No. 3,706,554; the phthalocyanine photoconductors of Borsenberger et al, U.S. Pat. No. 4,471,039 and the organic photoconductors of Rossi, U.S. Pat. No. 3,767,393; Fox, U.S. Pat. No. 3,820,989; and Rule, U.S. Pat. No. 4,127,412.

To prepare a single layer photoconductive element of the invention, the photoconductive layer composition containing the abhesive particles is solvent coated on an electrically conductive support at a thickness, for example, in the range from about 0.05 to 10 μm.

Multiactive photoconductive elements of the invention include not only a charge generating layer but also one or more charge transport layers. In such multiactive elements, the charge generating layer can have a thickness within a wide range depending upon the degree of photosensitivity desired. Thickness affects photosensitivity in two opposite ways. As thickness increases, a greater proportion of incident radiation is absorbed by the layer, but there is a greater likelihood of a charge carrier's being trapped and thus not contributing to image formation. These two factors must be balanced. A thickness in the range of about 0.05 to 5 μm provides maximum photosensitivity. At thicknesses much below 0.05 μm, there is inadequate absorption of actinic radiation whereas, at thicknesses much above 5 μm, there is excessive trapping of charge carriers.

The charge transport layers of the multiactive elements can be comprised of any material, organic or inorganic, which can transport charge carriers. Most charge transport materials preferentially accept and transport either positive charges (holes) or negative charges (electrons), although materials are known which will transport both positive and negative charges. Those exhibiting a preference for conduction of positive charge carriers are called p-type transport materials and those exhibiting a preference for the conduction of negative charges are called n-type.

Various p-type organic compounds can be used in the charge-transport layer, such as:

1. Carbazoles including carbazole, N-ethyl carbazole, N-isopropyl carbazole, N-phenyl carbazole, halogenated carbazoles, various polymer carbazole materials such as poly(vinyl carbazole), halogenated poly(vinyl carbazole) and the like.

2. Arylamines including monoarylamines, diarylamines, triarylamines and polmeric arylamines. Specific arylamine organic photoconductors include the non-polymeric triphenylamines illustrated in Klupfel et al U.S. Pat. No. 3,180,730 issued Apr. 27, 1965; the polymeric triarylamines described in Fox U. S. Pat. No. 3,240,597 issued March 15, 1966; the triarylamines having at least one of the aryl radicals substituted by either a vinyl radical or a vinylene radical having at least one active hydrogen-containing group, as described in Brantly et al U.S. Pat. No. 3,577,450 issued Mar. 2, 1971; the triarylamines in which at least one of the aryl radicals is substituted by an active hydrogen-containing group, as described by Brantly et al U.S. Pat. No. 3,658,520 issued Apr. 25, 1972; and tritolylamine.

3. Polyarylalkanes of the type described in Noe et al U.S. Pat. No. 3,274,000 issued Sept. 20, 1966, Wilson U.S. Pat. No. 3,542,547 issued Nov. 24, 1970, and Rule et al U.S. Pat. No. 3,615,402 issued Oct. 26, 1971. Preferred polyarylalkane photoconductors are of the formula:

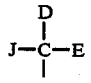

wherein D and G, which may be the same or different, represent aryl groups and J and E, which may be the same or different, represent a hydrogen atom, an alkyl group, or an aryl group, at least one of D, E and G containing an amino substituent. An especially useful charge transport material is a polyarylalkane wherein J and E represent hydrogen, aryl or alkyl and D and G represent substituted aryl groups having as a substituent thereof a group of the formula:

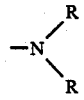

wherein R is unsubstituted aryl such as phenyl or alkyl-substituted aryl such as a tolyl group. Examples of such polyarylalkanes may be found in Rule et al U.S. Pat. No. 4,127,412 issued Nov. 28, 1978.

4. Strong Lewis bases such as aromatic compounds, including aromatically unsaturated heterocyclic compounds free from strong electron withdrawing groups. Examples include tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1,4-bromopyrene, phenylindole, polyvinyl carbazole, polyvinyl pyrene, polyvinyl tetracene, polyvinyl perylene and polyvinyl tetraphene.

5. Hydrazones including the dialkyl-substituted aminobenzaldehyde(diphenylhydrazones) of U.S. Pat. No. 4,150,987 issued Apr. 24, 1979, and alkylhydrazones and arylhydrazones as described in U.S. Pat. Nos. 4,554,231 issued Nov. 19, 1985; 4,487,824 issued Dec. 11, 1984; 4,481,271 issued Nov. 6, 1984, 4,456,671 issued June 26, 1984; 4,446,217 issued May 1, 1984; and 4,423,129 issued Dec. 27, 1983, which are illustrative of the p-type hydrazones.

Other useful p-type charge transports are the p-type photoconductors described in *Research Disclosure,* Vol. 109, May, 1973, pp 61–67, paragraph IV(A)(2) through (13).

Representative of n-type charge transports are strong Lewis acids such as organic, including metallo-organic, compounds containing one or more aromatic, including aromatically unsaturated heterocyclic, groups bearing an electron withdrawing substituent. These are useful because of their electron accepting capability. Typical electron withdrawing substituents include cyano and nitro; sulfonate; halogens such as chlorine, bromine and iodine; ketone groups; ester groups; acid anhydride groups; and other acid groups such as carboxyl and quinone groups. Representative n-type aromatic Lewis acids having electron withdrawing substituents include phthalic anhydride, tetrachlorophthalic anhydride, benzil, mellitic anhydride, s-tricyanobenzene, picryl chloride, 2,4-dinitrochlorobenzene, 2,4-dinitrobromobenzene, 4-nitrobiphenyl, 4,4-dinitrobinphenyl, 2,4,6-trinitroanisole, trichlorotrinitrobenzene, trinitro-o-toluene, 4,6,-dichloro-1,3-dinitrobenzene, 4,6-dibromo-1,3-dinitrobenzene, p-dinitrobenzene, chloranil, bromanil, 2,4,7-trinitro-9-fluorenone, 2,4,5,7-tetranitrofluorenone, trinitroanthracene, dinitroacridine, tetracyanopyrene, dinitroanthraquinone and mixtures thereof.

Other useful n-type charge transports are conventional n-type organic photoconductors, for example, complexes of 2,4,6-trinitro-9-fluorenone and poly(vinyl carbazole). Still others are the n-type photoconductors described in *Research Disclosure,* Vol. 109, May, 1973, pp 61–67, paragraph IV(A)(2) through (13).

A single charge transport layer or more than one can be employed. Where a single charge transport layer is employed, it can be either a p-type or an n-type substance.

In one useful configuration, the charge generation layer is between the conducting support and a charge transport layer or layers. This arrangement provides flexibility and permits control of the physical and surface characteristics of the element by the nature of the charge transport layer.

In another useful configuration called the inverted multilayer configuration, the charge transport layer is between the conducting support and the charge generation layer.

If the charge generation layer is to be exposed to actinic radiation through the charge transport layer, it is preferred that the charge transport layer have little or no absorption in the region of the electromagnetic spectrum to which the charge generation layer responds, thus permitting the maximum amount of actinic radiation to reach the charge generation layer. If the charge transport layer is not in the path of exposure, this does not apply.

Each of the charge generation and charge transport layers can be applied by solvent coating the active component in an electrically insulating film forming polymeric binder. Certain charge generation layers can, if desired, be vacuum deposited. The optimum ratio of charge generation or charge transport compound to binder can vary widely. In general, useful results are obtained when the amount of active charge generation or charge transport compound within the layer varies from about 5 to 90 weight percent based on the dry weight of the layer.

Binders in the charge generation and charge transport layers are film forming polymers having a fairly high dielectric strength and good electrical insulating properties. Examples include butadiene copolymers; polyvinyl toluene-styrene copolymers; styrene-alkyd resins; silicone-alkyl resins; soya-alkyd resins; vinylidene chloride-vinyl chloride copolymers; poly(vinylidene chloride); vinylidene chloride-acrylonitrile copolymers; vinyl acetatevinyl chloride copolymers; poly(vinyl acetals) such as poly(vinyl butyral); nitrated polystyrene; polymethylstyrene; isobutylene polymers; polyesterss such as poly[ethylene-co-alkylenebis-(alkyleneoxyaryl)phenylenedicarboxylate]; phenol formaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins) such as chlorinated poly(ethylene); etc.

Polymers containing aromatic or heterocyclic groups are most effective as binders because they provide little or no interference with the transport of charge carriers through the layer. Heterocyclic or aromatic containing polymers especially useful in p-type charge transport layers include styrenecontaining polymers, bisphenol A polycarbonate polymers, phenol formaldehyde resins, polyesters such as poly[ethylene-co-isopropylidene-2,2-bis(ethyleneoxy-phenylene)]terephthalate and copolymers of vinyl haloacrylates and vinyl acetate.

Especially useful binders for either the charge generation or charge transport layers are polyesters such as disclosed in the patents to Merrill U.S. Pat. No. 3,703,372; U.S. Pat. No. 3,703,371 and 3,615,406 and the patent to Berwick et al U.S. Pat. No. 4,284,699.

Although a wide range of polymers are useful as binders in the charge generating and charge transport layers, the binder for the layer which is the surface layer of the photoconductive element should be an uncrosslinked polymer. The reason for this requirement is that the surface layer contains the abhesive particles which are continually spread in a thin film across the surface. This is accomplished by the rubbing action of the copying machine cleaning station or other means which rub the surface and continually expose a fresh supply of the abhesive substance. If, however, the binder for the surface layer is a hard, crosslinked polymer, it will be so resistant to abrasion that after a short period of use the cleaning station or other means will not be able to rub away a thin layer at the surface and expose a fresh supply of the abhesive substance. Hence, in the photoconductive elements of the invention, the surface layer is a photoconductive layer containing, in addition to a photoconductor, the abhesive particles and an uncrosslinked polymeric binder.

The charge generation and charge transport layers can also contain other addenda such as leveling agents, surfactants and plasticizers to enhance various physical properties. In addition, addenda to modify the electrophotographic response of the element can be incorporated in the charge transport layer. For example, contrast control additives, such as certain hole trapping agents and easily oxidized dyes, can be incorporated in the charge transport layer. Such contrast control additives are described in *Research Disclosure,* Vol. 122, June, 1974, p 33, in an article entitled "Additives for Contrast Control in Organic Photoconductor Compositions and Elements".

When the charge generation layer or the charge transport layer is solvent coated, the components of the layer are dissolved or dispersed in a suitable liquid, together with the binder and other addenda. Useful liquids include aromatic hydrocarbons such as benzene, toluene, xylene and mesitylene; ketones such as acetone and butanone; halogenated hydrocarbons such as methylene chloride, chloroform and ethylene chloride; ethers including cyclic ethers such as tetrahydrofuran; ethyl ether; and mixture of the above.

A variety of electrically conducting supports can be employed in the elements of this invention, such as aluminum-paper laminates; metal foils such as aluminum foil, zinc foil, etc.; metal plates such as aluminum, copper, zinc brass and galvanized plates; vapor deposited metal layers such as silver, chromium, nickel and aluminum coated on paper or conventional photogrpahic film bases such as poly(ethylene terephthalate), cellulose acetate, polystyrene, etc. Conductive metals such as chromium or nickel can be vacuum deposited on transparent film supports in layers sufficiently thin to allow the electrophotographic elements to be exposed from either side. An especially useful conducting support can be prepared by coating a poly(ethylene terephthalate) support with a conducting layer containing a semiconductor dispersed in a resin. Such conducting layers, both with and without electrical barrier layers, are described in U.S. Pat. No. 3,245,833 by Trevoy issued Apr. 12, 1966. Other useful conducting layers include compositions consisting essentially of an intimate mixture of at least one protective inorganic oxide and 30 to 70 percent by weight of at least one conducting metal, e.g., a vacuum deposited cermet conducting layer as described by Rasch U.S. Pat. No. 3,880,657 issued Apr. 29, 1973. Likewise, a suitable conducting coating can be prepared from the sodium salt of a carboxyester lactone of maleic anhydride and a vinyl acetate polymer. Such conducting layers and methods for their preparation are disclosed in U.S. Pat. No. 3,007,901 by Minsk issued November 7, 1961, and U.S. Pat. No. 3,252,807 by Sterman et al issued July 26, 1966.

The various layers of the element can be coated directly on the conducting substrate. It may be desirable, however, to use one or more intermediate subbing layers to improvde adhesion with the conducting substrate or to act as an electrical barrier layer between the overlying layers and the conducting substrate, as described in Dessauer, U.S. Pat. No. 2,940,348. Such subbing layers typically have a dry thickness in the range of 0.01 to 5 $\mu$m. Subbing materials include film forming polymers such as cellulose nitrate, polyesters, copolymers of poly(vinyl pyrrolidone) and vinyl acetate, and various vinylidene chloride-containing polymers including two-, three- and four-component polymers prepared from a polymerizable blend of monomers or prepolymers containing at least 60 percent by weight of vinylidene chloride. Representative vinylidene chloride-containing polymers include vinylidene chloride-methyl methacrylate-itaconic acid terpolymers as disclosed in U.S. Pat. No. 3,143,421. Various vinylidene chloride-containing hydrosol tetrapolymers which may be used include tetrapolymers of vinylidene chloride, methyl acrylate, acrylonitrile and acrylic acid as disclosed in U.S. Pat. No. 3,640,708. Other useful vinylidene chloride-containing copolymers include poly(vinylidene chloride-methyl acrylate), poly(vinylidene chloride-methacrylonitrile), poly(vinylidene chloride-acrylonitrile) and poly(vinylidene chloride-acrylonitrile-methyl acrylate). Other useful subbing materials include the so-called tergels described in Nadeau et al U.S. Pat. No. 3,501,301 and the vinylidene chloride terpolymers described in Nadeau U.S. Pat. No. 3,228,770.

One especially useful subbing layer is a hydrophobic film forming polymer or copolymer free from any acid-containing group, such as a carboxyl group, prepared from a blend of monomers or prepolymers, each of said monomers or prepolymers containing one or more polymerizable ethylenically unsaturated groups. Such materials include many of the above-mentioned copolymers and, in addition, the following polymers: copolymers of polyvinyl pyrrolidone and vinyl acetate, poly(-vinylidene chloride-co-methyl methacrylate) and the like.

The improvded image transfer properties are also obtained in accordance with the invention with a wide range of dry toners and development techniques. The toners can be applied by any dry development technique including magnetic brush development or other development method using single component developers or two component developers with carrier particles. Useful toners include powdered pigmented resins made from various thermoplastic and thermoset resins such as polyacrylates, polystyrene, poly(styrene-co-acrylate), polyesters, phenolics and the like, and can contain colorants such as carbon black or organic pigments or dyes. Other additives such as charge-control agents and surfactants can also be included in the toner formulation.

Examples of suitable toner compositions include the polyester toner compositions of U.S. Pat. No. 4,140,644; the polyester toners having a p-hydroxybenzoic acid recurring unit of U.S. Pat. No. 4,446,302; the toners containing branched polyesters of U.S. Pat. No. 4,217,440 and the crosslilnked styrene-acrylic toners and polyester toners of U.S. Pat. No. Re. 31,072; the phosphonium charge agents of U.S. Pat. Nos. 4,496,643 and the ammonium charge agents of U.S. Pat. Nos. 4,394,430; 4,323,634, and 3,893,935. They can be used with plural component developers with various carriers such as the magnetic carrier particles of U.S. Pat. No. 4,546,060 and the passivated carrier particles of U.S. Pat. No. 4,310,611.

While the avoidance of the hollow-character defect has been discussed at length, it should be understood that electrophotographic elements of the invention, because of their excellent toner-transfer quality, provide other advantages. These include, for example, avoidance or reduction of mottle and of the so-called "halo" defect in multicolor images and improvement in the cleaning of the element between development cycles.

The invention has been described with reference to certain preferred embodiments, but it will be understood that variations and modifications can be made within the spirit and scope of the invention.

What is claimed is:

1. Reusable electrophotographic imaging element having a photoconductive surface layer adapted to receive electrostatic-charge latent images and to receive charged toner particles which develop such images for transfer to a receiver element, said surface layer comprising an uncrosslinked binder resin, a photoconductor and, heterogenerously dispersed therein as a separate phase, finely divided particles of an abhesive substance which is nonconductive and spreadable to form a thin film to which toner adheres less strongly than to the surface layer in the absence of said adhesive substance.

2. An element according to claim 1 wherein the abhesive substance is a wax-like, normally solid, low molecular weight tetrafluoroethylene telomer.

3. An element according to claim 2 wherein the concentration of said abhesive substance in said surface layer is greater than 10 percent by weight.

4. An element according to claim 1 wherein the element comprises a charge generation layer on an electrically conductive support, a charge transport layer as the surface layer and, between said charge transport layer and charge generation layer, a second charge transport layer which is free of said abhesive substance.

5. An electrophotographic copying method which comprises:

forming a uniform electrostatic charge on the surface layer of an electrophotographic element which is adapted to receive charged toner particles for transfer to a receiver element, said surface layer comprising an uncrosslinked binder resin, a photoconductor and, heterogeneously dispersed in said layer as a separate phase, finely divided particles of an abhesive substance which is non-conductive and spreadable to form a thin film having low surface adhesion, exposing the surface layer to a pattern of actinic radiation, applying charged toner particles to the surface layer to develop the resulting latent image pattern, transferring and fixing the developed image to a receiver sheet, and obtaining a transferred fixed image on the receiver sheet, which is substantially free of hollow characters.

6. The method according to claim 5 wherein the steps of charging, exposing, developing and transferring are repeated for a plurality of cycles and wherein, after each transferring step and before the developing step of the next cycle, the surface layer is rubbed to spread a thin film of the abhesive substance from within the layer onto its surface.

* * * * *